US011225829B2

(12) United States Patent
Mägi et al.

(10) Patent No.: US 11,225,829 B2
(45) Date of Patent: Jan. 18, 2022

(54) STRUCTURE OF FILLINGS FOR OPENINGS

(71) Applicant: AS Amhold, Tallinn (EE)

(72) Inventors: Arvu Mägi, Tallinn (EE); Joel Lipson, Tallinn (EE)

( * ) Notice: Subject to any disclaimer, the term of this patent is extended or adjusted under 35 U.S.C. 154(b) by 0 days.

(21) Appl. No.: 16/957,515

(22) PCT Filed: Nov. 29, 2018

(86) PCT No.: PCT/IB2018/059446
§ 371 (c)(1),
(2) Date: Jun. 24, 2020

(87) PCT Pub. No.: WO2019/130132
PCT Pub. Date: Jul. 4, 2019

(65) Prior Publication Data

US 2021/0062571 A1 Mar. 4, 2021

(30) Foreign Application Priority Data

Dec. 28, 2017 (EE) ..... U201700052

(51) Int. Cl.
*E04C 2/54* (2006.01)
*E06B 5/12* (2006.01)

(52) U.S. Cl.
CPC ..... *E06B 5/12* (2013.01)

(58) Field of Classification Search
CPC ..... E06B 5/12
See application file for complete search history.

(56) References Cited

U.S. PATENT DOCUMENTS 3,256,641 A * 6/1966 Johnson ..... E06B 3/5454 49/419
4,625,659 A 12/1986 Saelzer
4,854,248 A * 8/1989 Salzer ..... E04B 1/6116 109/79
6,319,571 B1 11/2001 Anglin, Jr.
6,333,085 B1 * 12/2001 Emek ..... F41H 5/013 428/34
6,497,077 B1 12/2002 Emek
7,174,692 B1 2/2007 Vickers et al.
(Continued)

FOREIGN PATENT DOCUMENTS

KR 20090124580 A 12/2009
KR 20110121300 A 11/2011
(Continued)

OTHER PUBLICATIONS

Wojan Window & Door Corporation, http://www.wojan.com/3%C2%BC-project-out-casement-blast-114/n 1p. retrieved Jun. 23, 2020.

*Primary Examiner* — Basil S Katcheves
(74) *Attorney, Agent, or Firm* — Meunier Carlin & Curfman LLC

(57) ABSTRACT

Structure of fillings for openings comprising a sheet material panel, a frame set, seals, a shock-dampening and absorption system, and insulation materials. With the filling structure for openings, the kinetic energy of a shock wave from an explosion is converted throughout the surface of the filling into a potential energy of the building, i.e. the kinetic energy of the shock wave is absorbed into the building.

11 Claims, 5 Drawing Sheets

(56) References Cited

U.S. PATENT DOCUMENTS

| | | | | |
|---|---|---|---|---|
| 7,546,711 | B2 * | 6/2009 | Salzer | E06B 5/12 52/204.5 |
| 7,861,761 | B2 * | 1/2011 | Martineau | E06B 9/54 160/31 |
| 8,863,440 | B1 * | 10/2014 | Champlin | F41H 5/013 52/1 |
| 10,280,679 | B2 * | 5/2019 | Al Kassas | E06B 3/5418 |
| 2011/0192328 | A1 | 8/2011 | Frest et al. | |
| 2012/0210862 | A1 | 8/2012 | Coddens | |

FOREIGN PATENT DOCUMENTS

| | | | |
|---|---|---|---|
| RU | 2597570 | C1 | 9/2016 |
| WO | WO2014/183610 | A | 11/2014 |

* cited by examiner

STRUCTURE OF FILLINGS FOR OPENINGS

PRIORITY

This application is a U.S. national application of the international application number PCT/IB2018/059446 filed on Nov. 29, 2018 and claiming priority of Estonian Utility Model application U201700052, the contents of both of which are incorporated herein by reference.

TECHNICAL FIELD

The invention belongs to the area of construction, ensuring security, civil defence, forensics, suppression of terrorism, protection systems (including industries specialising in handling of explosive gases, liquids, solids, aerosols and other dispersed mixtures). More specifically, the invention is about a structure of fillings forming an explosion-proof solution for openings, including window, door, flap, barrier wall or other filling for openings, of a building or a part thereof, including blocking and absorbing the effects of explosion.

PRIOR ART

Disclosed fire- and explosion-proof window structure solution (RU2597570, Mirzeabasov, T. A., published on Sep. 10, 2016) comprises a frame, a glass installation device, sealed glass units, layers of thermal insulation between the frame and the sealed units to create thermal insulation gaps strengthening the window structure. A drawback of the solution is that only the structure is fortified against the effects of shockwave from fire and explosion; therefore, the window frame and glass units become unreasonably resource-consuming because they have to receive the instantaneous dynamic impact of an explosion (i.e. residual shock wave of explosion) in its maximum value. The explosion pressure impacting the glass surface is transferred concentrated on the attachment of the frame and glass, and thus, in the event of significant explosion pressure, the structure breaks.

Disclosed solution (U.S. Pat. No. 4,625,659, Heinrich Saelzer, published on Dec. 2, 1986) involves a bullet- and explosion-proof structure comprising two board-shaped panels surrounded with three frames. The three frames are installed in a surface surrounding the filling for opening where the outer frame is spatially separated from the surface of the filling to create a gap between the frame and the surface of the filling. To prevent the entry of a shell into the building, the adjacent sides of frames are covered with security elements made of bullet-proof material. In the event of an explosion, the security elements expand to cover the critical surfaces of the frames. A drawback of the solution is that the pressure of a bullet and/or an explosion in its maximum capacity is received by rigid frames; therefore, the frames, bullet barriers and their attachments to the building, as well as the whole structure of the window or door become unreasonably resource-consuming.

There is disclosed a solution (U.S. Pat. No. 6,319,571, Anglin, Jr. Richard L, published on Nov. 20, 2001) where a lateral shift of windows and window elements takes place in the event of an explosion. The pressure forces of explosion move to the edges of the window and the window itself is presumed to remain intact. The solution includes a window frame supporting a panel of glass or synthetic material; the frame is attached to a base or receiver of the pressure by several fixing supports. The overpressure due to explosion causes a lateral shift of the frame from the receiving base, by which the overpressure of the explosion is moved to the edges of the shifted frame and the impact of the explosion is reduced. The fixers may be ribbons of woven material, a rope, metal or non-metal cables, nylon monofilaments. One method for obtaining an explosion-proof window panel is attachment of fabric or mesh into the material of the window panel or attachment of filaments to the fabric or mesh or frame. If the window panel shifts to the side, the filaments form a downward curvature and prevent the movement of the window panel exceeding the length of the filament. As the overpressure decreases, the window panel moves downward due to gravity. The drawbacks of the solution are that when the inner window frame moves inward due to explosion, the structure applies additional tensile stress to the fastenings, due to the opening of the inner window frame, the explosion pressure, effects and residues enter the rooms through the openings created along the extent of its fastenings (fixing details), causing significant overpressure and damages due to the effect of explosion residues, including high temperature, mechanical damages and injuries, health damages or death.

There is disclosed a solution (http://www.wojan.com/3%C2%6C-project-out-casement-blast-114/), where an elastic seal with D-shaped cross-section is used for explosion-proof filling for opening of a building (e.g. a window). A drawback of such a solution is a relatively too small absorption capacity of explosion energy and insufficient density in the conditions of the impulse and dynamic stress of explosion. Also, the disclosed solution does not work for the vacuum pressure following the shock wave of explosion (i.e. negative pressure) and thermobaric explosions, including explosions of vacuum bomb (including industrial or other flammable mixtures, air-dust mixture (e.g. fine dust of wood or another flammable substance), air-steam, air-flammable liquid drops, aerosols (including nano-particle aerosols)). Maximum impact of the shock wave of explosion to the part of the filling for opening between the frames creates bending stress and concentrated internal stress in the corners, causing the filling to break.

By technical nature, the closest one to the invention is explosion-proof device (KR20090124580, KN WALLDEX CO LTD, published on Dec. 3, 2009). The explosion-proof window comprises explosion-proof glass, a seal, a glass installation device, an internal frame, an external frame and an anchor bolt shock-absorbing device. The shock-absorbing device comprises the first shock-absorption bracket, a shock-absorber, the second shock-absorption bracket, supporting screws. The first shock-absorption bracket is connected to the internal frame, which is the first to receive the stress from an external explosion. The shock-absorber is in contact with one side of the first shock-absorption bracket, which is the second to receive the explosion stress from the first shock absorption bracket. The second shock absorption bracket is connected to the outer frame by a clip. The second shock absorption bracket also receives the explosion stress from the shock absorber and moves in the event of explosion stress due absorption of impact. Drawbacks of the solution are:

- the window frame is supported only at the location of the supporting elements and in the event of significant explosion stress, the structure breaks or is thrown into the building with the broken parts of the elements of support;
- compared to the amount of explosion energy, the explosion stress absorber on the support elements has a significantly lower reception capacity and only insufficiently softens the movement of the window frame in the event of maximum pressure effect of explosion (i.e. shock wave);

in the event of right-angle completion of the rectangular surface of the glass panels of window, the forces of explosion energy concentrate into the corners of the glass panels of window, and the resistance of the filling to explosion is at maximum only equal to those concentrated forces;

the structure of window is dimensioned rather rigidly in order to receive the maximum explosion stress and impacts, which makes it necessary to build it in a resource-consuming way;

also, this disclosed solution does not work for the interior doors, windows and barrier walls of a building or a part thereof if the explosion occurs inside the building, and/or in the event of negative stress (vacuum).

The purpose of development of the present solution is:

to prevent the breakage of the part between the frames of filling for openings;

to ensure the air-tightness of the structure of the filling for openings;

to reduce the effects of powerful explosion (including shock wave pressure, effects of the impact of residual explosions when colliding with the filling for openings);

to reduce the high impact of energy exposure to the building and the filling for openings;

increased resistance of the filling structure for openings if there is an explosion inside the building and in the event of negative stress;

to protect the interior of the building from intense light, heat and electrical-magnetic exposure.

SUMMARY OF THE INVENTION

The filling structure for openings corresponding to the invention comprises:

a panel of sheet material comprising an internal set of sheet material and an external set of sheet material, whereas the panel of sheet material has a double-sided cross-section curved in opposite direction, and the parts of the sheet material are covered with protective measures against heat, light and electromagnetic exposure;

a frame set comprising three frames: an outer frame, an inner frame and the frame of sheet material panel, whereas the frames are installed inside each other;

a shock-dampening and absorption system comprising an absorption installation and shock-absorbers with three functions: preliminary shock-absorbers of explosion stress, post-shock-absorbers and final pressure shock-absorbers, whereas the gaps between shock-absorbers are filled with elastic filler seals.

LIST OF FIGURES

EMBODIMENTS OF THE INVENTION

Figure 1:
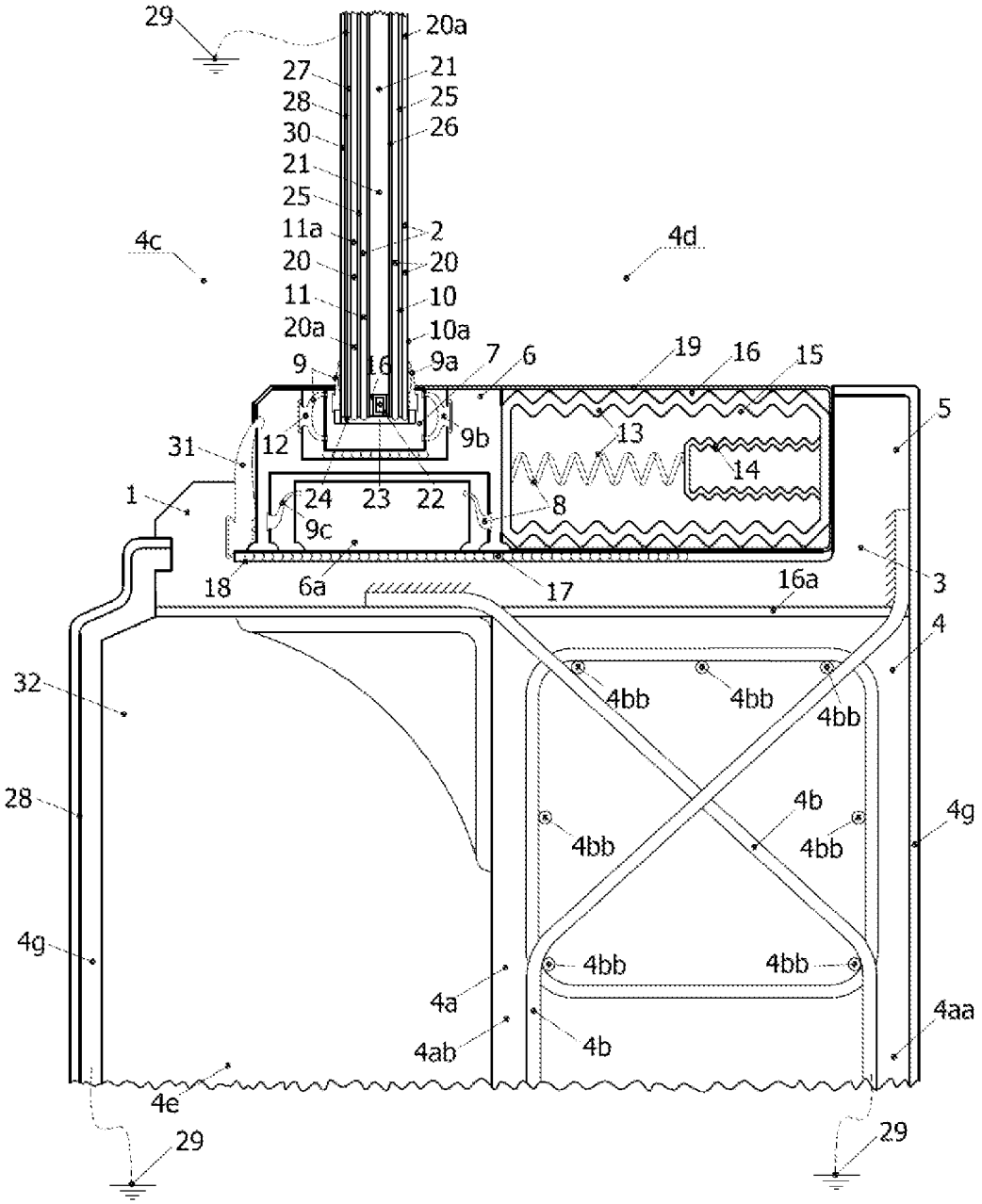
FIG. 1 shows a section of the invention structure in the event of an explosion outside the building.
Figure 2:
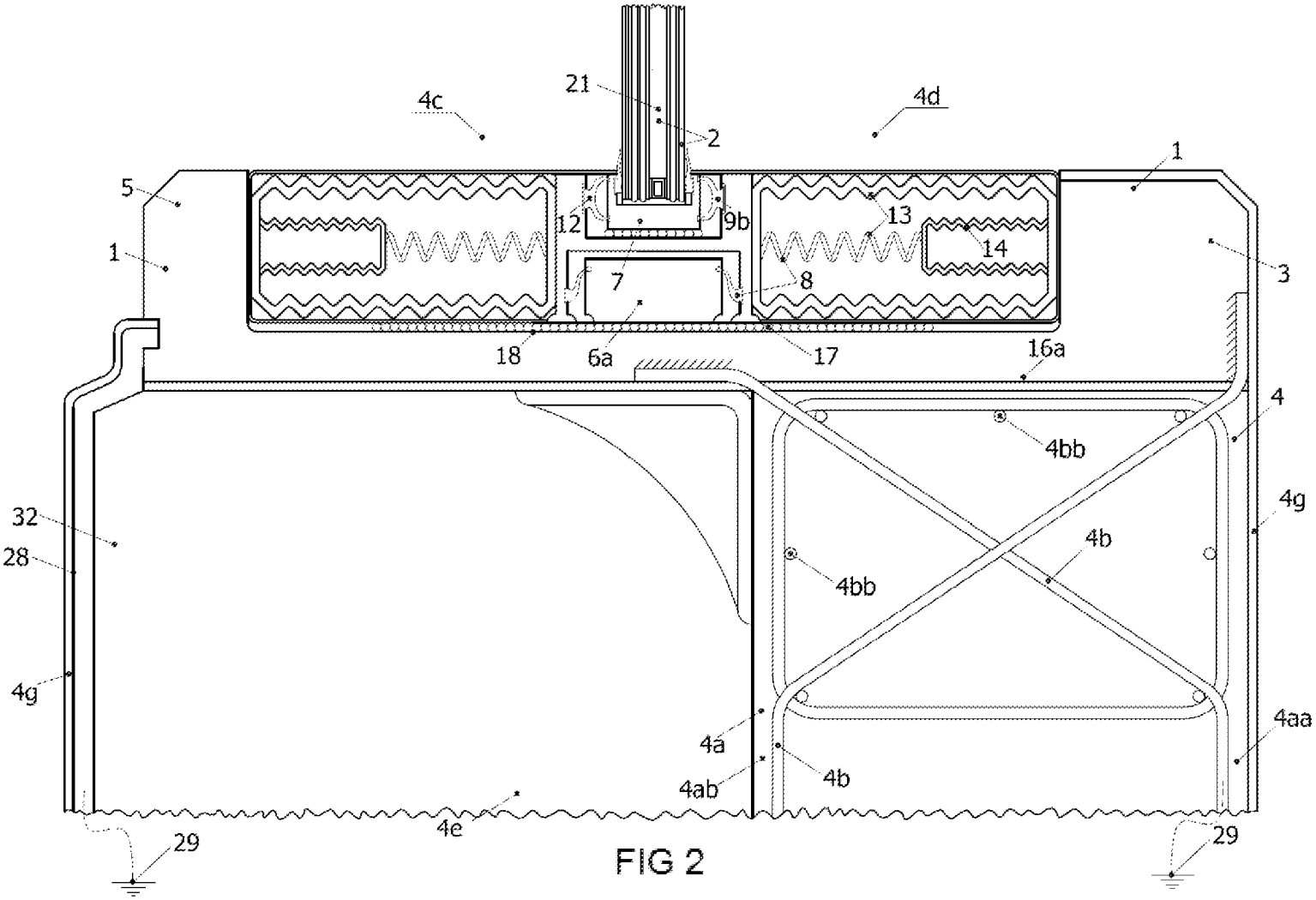
FIG. 2 shows a section of the invention structure in the event of a potential explosion outside or inside the building.
Figure 3:
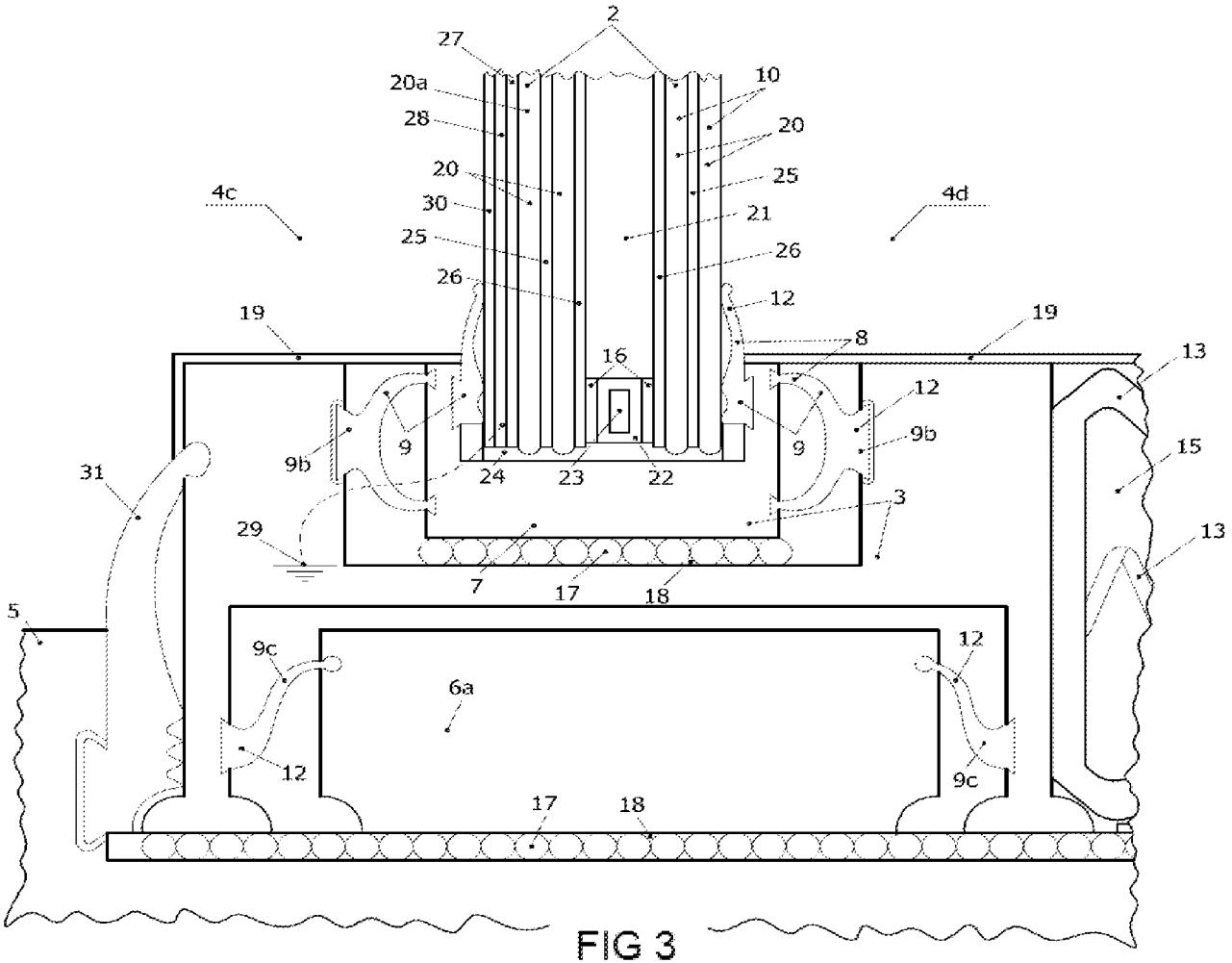
FIG. 3 shows the magnified sheet material panel section of the invention structure.
Figure 4:
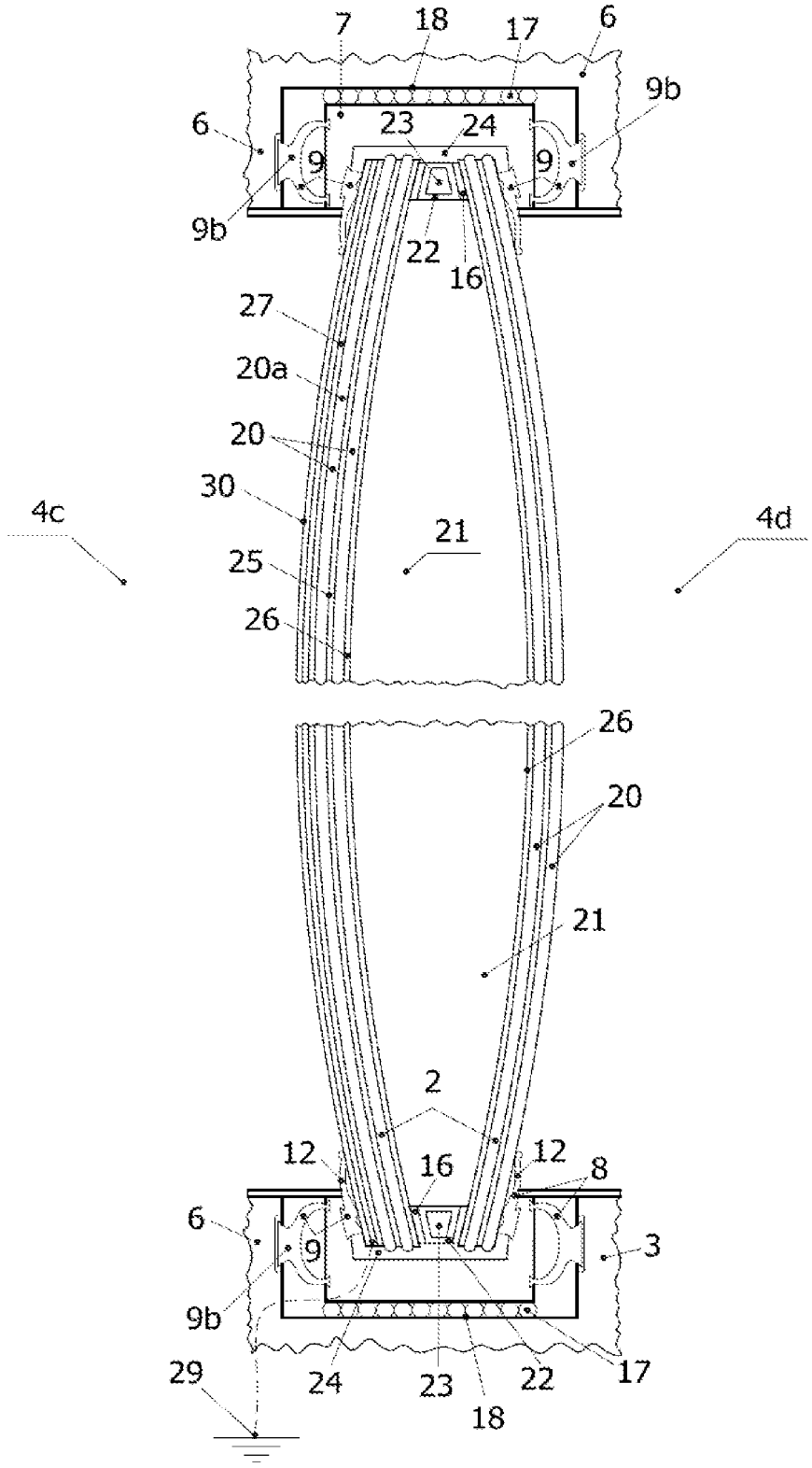
FIG. 4 shows the longitudinal section of the filling structure for openings.
Figure 5:
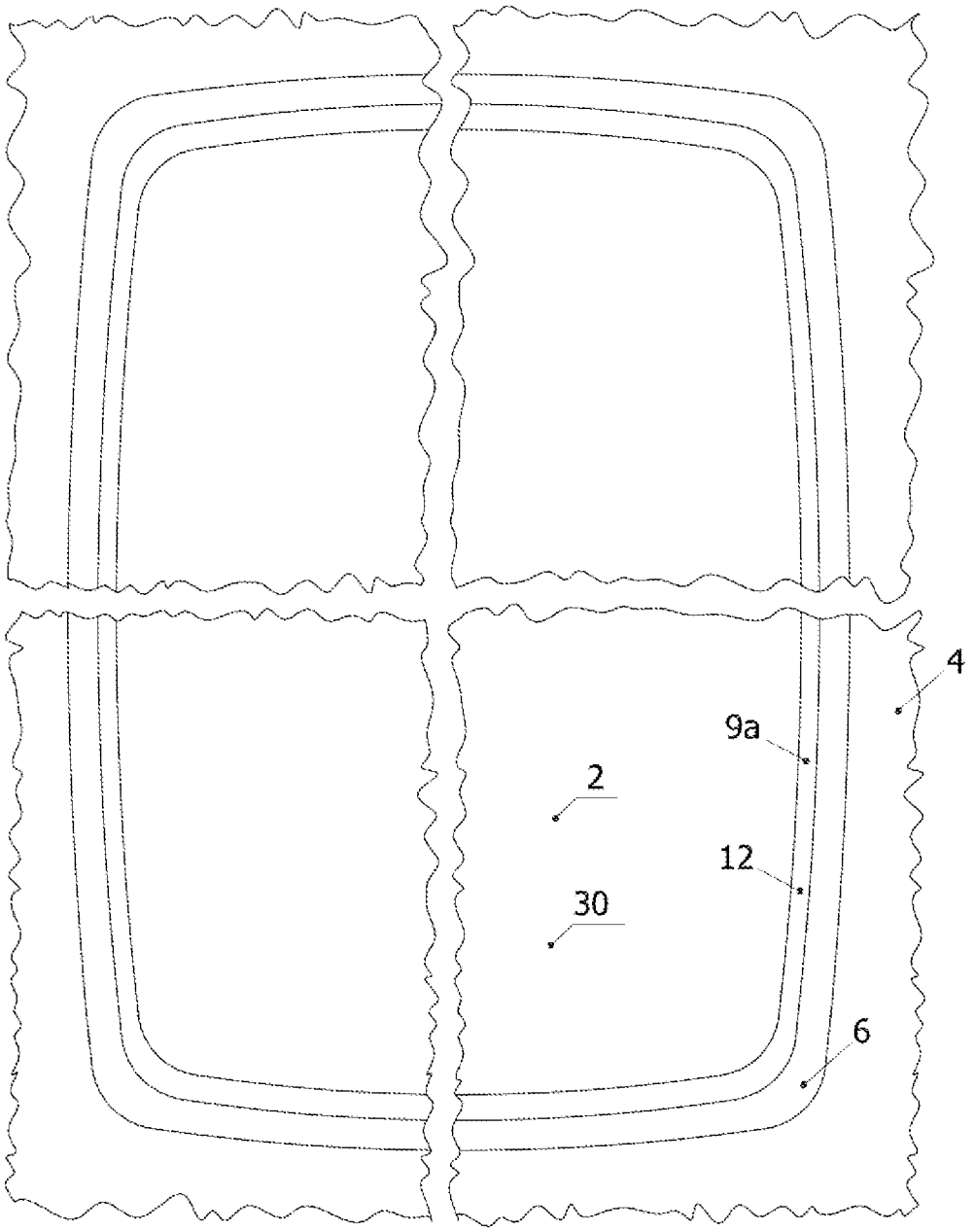
FIG. 5 shows a view of the filling structure for openings from outside the building, i.e. from the direction of influence of a shock wave.

With the filling structure for openings, the kinetic energy Ek of a shock wave from an explosion is converted throughout the surface of the filling into a potential energy of the building $E_p$ and absorbed therein, i.e. the kinetic energy of the shock wave $E_k$ is absorbed into the building, i.e. $E_k=E_p$. Thereby, a significant part of the effects of the explosion are reflected, managed, bounced in ricochet and/or at an angle away from the building by special elements of the filling structure for openings. The filling structure for openings has been executed with such a functionality that non-elastic bouncing of a shock wave is organised to a significant extent $\varepsilon>1$) by the sheet material panel section of the filling structure for openings and a frame set by which the kinetic energy of the shock wave Ek is absorbed in the building into its potential energy $E_p$. Upon the reception of a shock wave (i.e. bouncing), shock-dampening and absorption, the weight of the sheet material panel section of the filling structure for openings ($m_{lp}$) and the weight of the frame set ($m_{rk}$) is increased plastically-elastically smoothly and in a significant extent (over 100 times) compared to the weight of the shock wave ($m_{ll}$) impacting the surface of the filling for openings, i.e. $m_{lp}+m_{rk}>100\ m_{ll}$.

The filling structure for openings 1 (i.e. explosion-proof filling structure for openings of a building's casing, e.g. a window, door, flap) comprises a panel of sheet material 2, a frame set 3, a systematic set of shock-dampening and absorption devices i.e. a shock-dampening and absorption system 8 where the effects of an explosion, including the pressure caused by the kinetic energy of a shock wave, is partially reflected, bounced and received by sheet material panel 2 which transfers the stress of the shock wave to frame set 3 and the shock-dampening and absorption system 8 and through those, elastically-rigidly (i.e. semi-rigidly) to load-bearing structure 4*a* of building 4, and the kinetic residual energy of the explosion is absorbed to the load-bearing structure 4*a* via the absorption installation 4*b* (i.e. semi-rigid armour, i.e. semi-rigid ties and tensile armour 4*bb* (i.e. frame armour located in the load-bearing structure 4*a* in the filling structure for openings 1)).

The interaction functionality of the parts of the filling structure for openings 1 is constructed so that the effects of explosion received by the surface of sheet material panel 2 (including the stress of residual explosion resulting from the kinetic energy of a shock wave) are classified into five stages of explosion effects which differ from one another by duration, operation and the extent and dynamics of the effect of the pressure: the stages of bouncing, pulse-stress, dynamic stress, quasi-static s tress (i.e. semi-static) and negative stress. Reflection, bouncing, prevention, management, shock-dampening and absorption of explosion stress and other effects of explosion and securing the filling structure for openings 1 while moving from one stage of explosion effects to another is carried out as a symbiosis of elastic and plastic bounces, and smoothly uniting and integrating the cooperation of the system of the parts of the filling structure for openings 1 in shock-dampening and absorption into the load-bearing structure 4*a* of building 4.

Sheet material panel 2 is made of a set of inner sheet material (e.g. glass, polycarbonate) 10 and a set of outer sheet material (e.g. glass, polycarbonate) 11 with a double-sided cross-section curved in opposite direction and a surface with curved edges and corners by which a transfer of explosion stress is ensured to the inner frame 6 of the filling structure for openings 1 by the double-sided structure with curved cross-section in opposite direction and curved edges and corners (i.e. sheet material panel 2).

Sets 10 and 11 of sheet material panel 2 are made of composite electromagnetic, heat and light exposure insulation layer and layers forming structural strength (including layers transferring the pressure of the shock wave of explosion to the pre-tensioned frame 7 of the sheet material panel, i.e. explosion pressure is transferred by curved sheet material as pressure tensions to the pre-tensioned frame 7 of the sheet material panel 2 where thus additional tensile stress reaction is created).

Between sheet material panel 2 (with weight $m_2$) and the pre-tensioned frame 7 of the sheet material panel (with weight $m_7$), an elastic and air-tight pressure-tensioned seal/shock-absorber 9*a* has been installed, by which the kinetic energy is harmonised and elastically transferred to the pre-tensioned frame 7 of the sheet material panel. Between the pre-tensioned frame 7 (with weight $m_7$) and the inner frame 6 (with weight $m_6$) of a sheet material panel, an elastic shock-absorber/seal 9*b* operating as a spring has been installed by which, in turn, the kinetic energy of a shock wave is transferred to the inner frame 6, reducing the movement speed of the shock wave by increasing the total weight of frames 6 and 7 and shock-absorber/seals 9*a* and 9*b* by elastic forces Fa and Fb. Into the inner frame 6, by the elastic shock-absorber 9*c* operating as a spring, an inertia weight element 6*a* (with weight $m_{6a}$) has been installed by which the movement speed of the shock wave is further reduced in the impulse-stress stage by significantly increasing the total weight of sheet material panel 2 and frames 6 and 7 and the inertia weight element 6*a* (i.e. $m_2+m_6+m_{6a}+m_7$) and the elastic force $F_c$ of shock absorber 9*c*.

The sizes of seals/shock-absorbers 9*a*, 9*b* and 9*c*, frames 6 and 7 and inertia weight element 6*a* and the elastic forces $F_a$, $F_b$ and $F_c$ of seals/shock-absorbers 9*a*, 9*b* and 9*c* have been composed so that the total weight of sheet material panel 2 and frame set 3 moving due to the impact of shock wave is smoothly (i.e. consistently, without jumps) and significantly (at least over two times) increased, resulting in a significantly reduced movement speed of sheet material panel 2 and frames 7 and 6 in the impulse-stress stage of explosion.

The frame set 3 of the filling structure for openings 1 comprises three frames installed inside each other—outer frame 5, inner frame 6 and the pre-tensioned frame 7 of sheet material panel, which are interconnected by the shock-dampening and absorption system 8 and a set of installations with a combination of elastic and air-tight seals 9 (including 9*a*, 9*b* and 9*c*).

In frame set 3, the shock wave impulse of an explosion, the pressure of the dynamic, quasi-static and negative stage are blocked, shock-dampened and absorbed by the shock-dampening and absorption system 8 with different stages of elasticity and the set of installations 9 with a combination of elastic and air-tight seals. The residual stress of an explosion is absorbed by plastically rigid (i.e. semi-rigid) ties i.e. armour i.e. absorption installation 4*b* and tensile armour 4*bb* (i.e. frame armour 4*bb* located in the load-bearing structure 4*a* of filling for openings 1) into the rather rigid (i.e. semi-rigid) load-bearing structure 4*a* of building 4.

The shock-dampening and absorption system 8 comprises three shock-absorber sets with different performance characteristics—preliminary shock-absorbers of explosion stress 12, post-shock-absorbers 13 and final pressure shock-absorbers 14.

Preliminary shock-absorbers 12 are created of a systemic set of installations of elastic and shock-dampening seals, a combination of the weights of the frames in the frame set and the inertia weight, working by the principle of shock-absorption.

The preliminary shock-absorbers 12 elastically receive the maximum short-time impulse-stress due to the pressure caused by the kinetic energy Ek of a shock wave from a powerful explosion impacting sheet material panel 2, pre-tensioned frame 7 of the sheet material and the inner frame 6 of the filling structure for openings, and the effective stress is harmonised, its amount is reduced and it is subsequently elastically transferred to post-shock-absorbers 13. By preliminary shock absorbers 12, sheet material panel 2, pre-tensioned frame 7 of the sheet material and the inner frame 6 of the filling structure for openings of the filling structure for openings 1 are allowed to move elastically, which reduces the speed (the speed of the shock wave is reduced in average by 20 to 60%) and the stress (the stress is reduced in average by 60 to 80%) of the shock wave impacting the surface of the filling structure for openings 1 and by which the amount of the possible speed and distance of dynamic movement of the inner frame 6 of the filling structure for openings is significantly reduced (20 to 80% in average).

Post-shock-absorbers 13 are created from shock-absorbers with rather high elasticity, length and shock-absorbing power (i.e. compared to preliminary shock-absorbers 12), e.g. a bellow-shaped device dampening and absorbing kinetic energy (including e.g. a device of elastic alloy steel which deforms elastically and its strength of resistance to pressure, i.e. elastic force, increases under compression); springs of alloy steel; pneumatic or hydraulic cylinders; another material elastically deforming to a significant extent the compression strength (i.e. resistance to external pressure) of which increases elastically depending on the effective force and the deformation of the shock-absorber).

Post-shock-absorbers 13 (i.e. compared to preliminary shock-absorbers 12, post-shock-absorbers have a more than 3 times longer movement range and are over 2 times more rigid shock-absorbers) receive and eliminate by their elastic force smoothly elastically and plastically the stress caused by the dynamic pressure of explosion and the placement (i.e. movement) of the filling structure for openings 1 due to the pressure of the shock wave. Post-shock-absorbers 13 receive and elastically transfer the impact of a shock wave from an explosion to the outer frame of the filling structure for openings 1 and from there on to the load-bearing structure 4*a* of building 4 for a much longer duration (post-shock-absorbers work in average 10 to 40% of the effective time of a shock wave and do that in the third effective stage of the shock wave i.e. in the stage of dynamic pressure) compared to preliminary shock absorbers 12 (preliminary shock absorbers 12 work in average 0 to 20% of the effective time of a shock wave and do that in the second effective stage of the shock wave, i.e. in the impulse-pressure stage).

Final pressure shock-absorbers 14 receive the movement impulse of moving sheet material panel 2 and frames 6 and 7 and the total weight of the inertia weight element 6*a* of the internal frame 6 of the frame set, dampening it and transferring its impact to outer frame 5. Final pressure shock-absorbers have been constructed to perform in the negative (i.e. fifth effective stage of shock wave) and quasi-static pressure stage (i.e. fourth effective stage of shock wave) of an explosion, i.e. upon semi-static pressure with the extent of 5 to 10% of the maximum overpressure caused by the explosion and their operating time is 20 to 80% of the effective time of the shock wave in its last effective stage.

Compared to post-shock-absorbers 12, final pressure shock-absorbers 14 are in average made of 10 to 60% shorter and more rigid shock-absorbers, the elastic force of which is at least 1.5 times bigger than that of preliminary and post-shock-absorbers 12 and 13 (e.g. springs of alloy steel or pneumatic or hydraulic cylinders, or another significantly elastically deforming material with compression strength increasing elastically depending on the effective force).

The gap between shock-absorbers 12, 13 and the final pressure shock-absorbers 14 (elastic, operating on spring principle) is filled with elastic filler seals 15 which can be, for instance, elastic material with closed pores (e.g. polyurethane foam), with a deformability enabling shock-absorbers 12, 13 and 14 to deform due to explosion stress, and by which their protection from external influence (e.g. mechanical damages, harmful effect of UV-radiation, influence of weather, etc.) and long-term operability are ensured.

The elastic filler seals 15 of post- and final pressure shock-absorber 13, 14 are glued in air-tight manner by an elastic and air-tight layer of glue 16 to frames 5, 6 and shock-absorbing system 8 of the filling structure for openings 1.

Frames 5, 6 of the filling structure for openings 1 are installed inside each other, on elastic rollers 17 (made of e.g. polycarbonate or steel material) enabling their movement. The gap of rollers 17 is filled with viscous and tightening lubricant 18 ensuring smooth movement and longevity of the rollers.

The surface of the shock-dampening and absorption system 8, elastic filler seal 15 and frames 5, 6 of the filling structure for openings 1 is covered with an elastically deformable material 19 (e.g. of polyester fabric plasticised with a layer of fire retardant polyvinyl and covered with a layer of acryl).

Outer frame 5 of the filling structure for openings 1 is installed on the load-bearing structure 4*a* of building 4 on an air-tight levelling and glue layer 16 in a stationary manner and then anchored by elastically rigid (i.e. semi-rigid) anchors i.e. by absorbing installation 4*b* load-bearing structure 4*a*, absorbing the residual explosion stress (i.e. residual deformation of the outer frame) by such a constructive solution into the semi-rigid load-bearing structure 4*a*.

The semi-rigidity of the load-bearing structure 4*a* is achieved by double-sided armouring of the load-bearing structure 4*a*, where the armouring 4*b* is carried out in the inner surface layer of load-bearing structure 4*a*, inner surface layer 4*aa* and outer surface layer 4*ab*.

The residual stress of the outer frame 5 of the filling for openings 1 and the elastic residual deformation are harmonised and transferred and absorbed in the load-bearing structure 4*a*, by installing a tensile armour 4*bb* in addition to armour 4*b* (i.e. frame armour 4*bb* of the load-bearing structure 4*a* of filling for openings 1), which is installed around frame 5 of the filling for openings 1 into the load-bearing structure 4*a* and is rigidly connected to armouring 4*b* of the load-bearing structure 4*a*.

If glass 20 of the glass set is used as the material for the pressure layer in the sheet material panel 2 (if one of the functions of the filling structure for openings 1 is letting light through the opening), sets 10, 11 of sheet material panel 2 (in such an event, glass sets 10*a*, 11*a*) are, in turn, made of at least two and at least double-sided and laminated and fortified-glass composite, i.e. glass set 10*a*, 11*a*. Pressurised inert gas 21 (e.g. argon or krypton) has been installed between glass sets 10*a*, 11*a* by which a cross-section curved in opposite direction with each other is formed. By the cross-section curved in opposite direction of glass sets 10*a*, 11*a*, explosion-stress transfer is carried out to the inner frame 6 of frame set 3 of the filling structure for openings 1 by the curved shape of the material, where the surface of outer glass set 11*a* is put under pressure and then the pressure is transferred to the pre-tensioned frame 7 of the sheet material, which is put under additional tension by glass sets 10*a* and 11*a*. The tensile strength and rigidity of the material of the pre-tensioned frame of the sheet material panel are executed in order to receive the tensile forces created by the pressure forces due to the expansion of glass sets 10*a* and 11*a* in their full extent, and considering the possible reserve.

By the pressurised inert gas located between glass sets 10*a*, 11*a*, the explosion stress is partly transferred to the inner glass set 10*a*, due to which two or more glass sets 10*a* and 11*a* are commissioned to receive the explosion stress and to transfer the force caused by the stress to inner frame 6 of the filling for openings 1.

The explosion stress is transferred to inner frame 6 of the filling structure for openings 1 (mainly in the stage of impulse-stress and dynamic stress of explosion) by the curved shape of the outer glass set 10*a*. The curved shape of glass sets 10*a*, 11*a* curved in opposite directions is achieved by filling the sheet material panel 2 with inert gas 21 under overpressure (i.e. compared to the natural pressure of the external environment of building 4*c*), or by creating a curved shape for glass sets 10*a*, 11*a* already in the factory. The size of the curvature of the outer glass set 11*a* of sheet material panel 2 is executed depending on the possible amount of explosion stress (i.e. shock wave stress), i.e. the bigger the potential stress, the bigger the curvature.

With the help of the double-sided curvature of sheet material 2 in opposite directions, among other things, the spreading of the significantly loud sound (bang) through the filling structure for openings 1 is also insulated.

A strip 22 with holes, i.e. a sieve-like surface, has been installed between glass sets 10*a*, 11*a* (it is made of e.g. a ceramic material, a metal alloy or plastic) comprising absorbent material 23 which collects the possible moisture between glass sets 10*a*, 11*a* in the event of variations in temperatures in the external environment of building 4*c* during the exploitation. Glass sets 10*a*, 11*a* are interconnected in air-tight manner by a sealant and glue 24 (e.g. a polysulphide and/or butyl mass and an air-tight glue layer 16) and installed into the pre-tensioned frame 7 of the sheet material panel, which in turn is installed into the inner frame 6 of the filling structure for openings 1.

The thicknesses of glass sets 10*a*, 11*a* of sheet material sets 10 and 11 (including weights) in the sheet material panel 2 are significantly different, by which resonance is avoided and significant transfer of sound noise through the sheet material panel 2 is blocked by dampening of its waves (i.e. sound).

Glass sets 10*a*, 11*a* of sheet material panel 2 consist of layers and are made of glasses 20, which is fortified and has micro-layered safety films 25 glued between the layers (i.e. Polyvinyl butyral—PVB micro-layered safety film). The number of glasses 20 and the safety films 25 between those (at leas two glasses 20 and one micro-layered safety film 25 between those) depends on the potential compression strength of the shock wave of an explosion, and the strength of the potential mechanical impact of the residual explosion.

The edges and corners of glasses 20 of glass set 10*a*, 11*a* are made with curved surface, by which concentration of inner tension at the edges of glass 20 is avoided.

The inner glass set 10*a* and outer glass set 11*a* of sheet material panel 2 are covered from inside of sheet material panel 2 with a transparent selective layer 26, i.e. an emissive cover. By the emissive cover of selective layer 26 on the inner surface of glass set 10*a*, thermal radiation is reflected back to the inner space 4*d* of building 4 during exploitation under normal circumstances. In the event of an explosion in the external environment 4*c* of building 4, thermal radiation is reflected back to the external environment 4*c* of building 4 via the selective layer 26 in the inner surface of the external glass set 11*a*.

Additionally, the surface of the outer glass 20*a* of the outer glass set 11*a* is covered with a light-reflecting layer 27, ensuring reflection of the significant thermal radiation and thus thermal energy back in a faded manner or to the side from the curved surface of the outer glass set 11*a*, by which entry of thermal energy into inner premises 4*d* and ignition of people and interior are avoided.

Depending on the functional security task, the surface of the outer glass 20*a* of the outer glass set 11*a* is covered with a fine, conductive mesh 28, ensuring the privacy of inner space 4*d* compared to the outer premises 4*c* (i.e. it is not possible to see from a distance outside what is happening in inner premises 4*d*); however, normal view from inner premises 4*d* to outer premises 4*c* is ensured.

To avoid entry of electromagnetic exposure, a fine mesh 28 of electricity conductive material (e.g. steel, copper, aluminium etc. electricity conductive materials) applied to the surface of outer glass 20*a* of glass set 11*a* is produced. The electricity conductive mesh 28 applied to the surface of the outer glass 201 is connected to earth 29 and the equipotential contour of building 4, including the absorption installation 4*b* of the load-bearing structure (i.e. armouring) 4*a* and tensile armouring 4*bb*.

In the event of building 4 that only has the protection and security function, the mesh 28 applied to the surface of the outer glass 20*a* of glass set 11*a* of the filling structure for openings 1 is covered (e.g. painted) with a light-reflecting and heat-resistant cover (e.g. a paint cover) with 30 albedo value over 90. By reflecting the light of glasses 20 of glass sets 10, 11 of the filling structure for openings 1 and the mesh 28 applied to it, which shields and earths electromagnetic radiation, in the event of explosion of a powerful bomb or another explosive its light radiation energy is reflected and dispersed away from building 4 (including the filling structure for openings 1), and the ignition or damage to any objects and people in the inner premises 4*c* due to intense and very powerful light radiation is avoided.

Between the inner frame 6 and outer frame 5 of the filling structure for openings 1 (on the outside of the frames), a flap-shaped elastic air-tight compression seal 31 is placed, so that in the event of positive pressure an elastic flap is pressed against the outer frame 5 of the filling structure for openings 1, and the tightness of the frame set increases significantly (i.e. compression due to explosion) and by which the tightness and air-tightness of the frame set is ensured.

The filling structure for openings 1 is attached to the load-bearing structure 4*a* (e.g. reinforced concrete, steel grid, stone wall or another strong and massive material forming the load-bearing structure 4*a* of a building or machine, i.e. the supporting frame) of building 4 with an air-tight and surface-levelling layer of glue 16*a* rigidly and in stationary manner to the level of the peripheral structure's (including e.g. a wall) thermal insulation 4*e* and shock-dampening layer 32. The shock-absorbing layer 32 of building 4 is e.g. a mineral compressible thermal insulation 4*e* by which also the impulse-pressure of explosion to the peripheral load-bearing structure 4*a* of building 4 is absorbed, and additionally the insulation against electromagnetic radiation (e.g. a steel mesh 28), which is connected to earth 29. The shock-absorbing layer 32 of building 4 is protected from the external environment with a protective hydrophobic insulation layer 4*g*.

The filling structure for openings 1 and its ingredients are created as heat-resistant, to endure the significantly elevated temperatures caused by explosion.

The filling structure for openings 1 in the exploitation terms of building 4 (including windows, flaps, doors, barrier wall modules or other fillings for openings of the peripheral structure of building 4 or a part thereof) are closed before the explosion in an air-tight manner by an automatic control system, having received a notification/signal of a potential explosion by the preliminary warning system.

The frame set 3 of the filling structure for openings 1 is installed on the load-bearing structure 4*a* of building 4 so that the sheet material package 2 is located before the load-bearing structure 4*a*, at the level of the thermal insulation 4*e* and the shock-dampening level 32 of the building.

The load-bearing structure 4*a* of the building is covered by a protective layer 4*g* insulating against the environmental impacts.

The invention has achieved the established goal, as the building's filling structure for openings is explosion-proof (i.e. it blocks, reflects, bounces, earths, dampens and absorbs the effects of an explosion) in the event of explosions of different types (i.e. the effect of the shock wave from a thermobaric and high-impact explosion in the stages of bouncing, pulse-stress, dynamic stress, quasi-static stress and negative stress) both in the external and internal environment of a building.

LIST OF MARKINGS

1—Structure of fillings for openings
2—Sheet material panel
3—Frame set
4—Building
4*a*—Load-bearing structure
4*aa*—Internal surface layer of the load-bearing structure
4*ab*—External surface layer of the load-bearing structure
4*b*—Shock-absorbing installation
4*bb*—Tensile armouring
4*c*—External environment of the building
4*d*—Internal environment of the building
4*e*—Thermal insulation and shock-dampening layer of the building
4*g*—Protective layer of the building against environmental impacts
5—Outer frame of frame set 3
6—Inner frame of frame set 3
6*a*—Inertia weight element of the inner frame of the frame set
7—Pre-tensioned frame of the sheet material panel of the frame set
8—Shock-dampening and absorption system
9—A set of installations with a combination of elastic and air-tight seals
9*a*—Elastic and air-tight pre-tensioned seal/shock-absorber
9*b*—Elastic shock-absorber/seal operating as a spring
9*c*—Shock-absorber operating as a spring
10—Inner set of sheet material
10*a*—Inner glass set
11—Outer set of sheet material
11*a*—Outer glass set
12—Preliminary shock-absorber
13—Post-shock-absorber
14—Final pressure shock-absorber

15—Elastic filler seal
16—Air-tight and elastic glue layer
16*a*—Air-tight and building surface levelling glue layer
17—Roller
18—Viscous and tightening lubricant
19—Elastically deforming material
20—Glass of the glass set
20*a*—Outer glass
20*b*—Another light-permeable material
21—Inert gas
22—Strip with holes, with sieve-like cover, for glass sets
23—Absorbent material
24—Air-tight sealant and glue
25—Micro-layered safety film
26—Selective layer
27—Light-reflecting layer
28—Fine electricity conductive mesh
29—Earth
30—Light-reflecting and heat-resistant cover
31—Flap-type compression seal
32—Peripheral shock-dampening layer of building.

The invention claimed is:

1. A structure of fillings for openings comprising a sheet material panel, a frame set, seals, a shock-dampening and absorption system, and insulation materials, wherein the sheet material panel comprises an internal set of sheet material and an external set of sheet material, the sheet material panel has a double-sided cross-section curved in opposite directions, and parts of the sheet material are covered with protective measures against heat, light and electromagnetic exposure;

the frame set comprises three frames installed inside each other an outer frame, an inner frame and a pre-tensioned frame of sheet material panel, and an inertia weight element installed in the inner frame, wherein the frames are interconnected by the shock-dampening and absorption system and a set of installations with a combination of elastic and air-tight seals, and the outer frame is connected to an absorbing installation located in a load-bearing structure of a building;

the shock-dampening and absorption system comprises the absorption installation and shock-absorbers with three different functions: preliminary shock-absorbers of explosion stress, post-shock-absorbers and final pressure shock-absorbers, wherein gaps between shock- absorbers are filled with elastic filler seals; and wherein the structure of fillings for openings includes protective measures against heat, light and electromagnetic exposure, air-tight and elastic sealing installations.

2. The structure of fillings for openings according to claim 1, wherein the frames of the structure of fillings for openings are installed inside each other on rollers enabling their movement, wherein a gap between the rollers is filled with viscous and tightening lubricant and a flap-type compression seal is installed between the inner frame (6) and the outer frame.

3. The structure of fillings for openings according to claim 1, wherein the sheet material panel is an internal set of sheet material comprising an inner glass set and an external sheet material set comprising an external glass set, pressurised inert gas has been installed between the glass sets , glass sets are made of at least two and at least double-sided and laminated glass composite and the glass sets comprise insulation layers against electromagnetic exposure, thermal and light radiation.

4. The structure of fillings for openings according to claim 3, wherein the glass sets are installed into a pre-tensioned frame of the sheet material of the frame set, which in turn is installed in the inner frame of the frame set, a strip filled with absorbent material is installed between the glass sets and the glass sets are interconnected with air-tight sealant and glue, and the glass sets are covered from inside of the sheet material panel by a selective layer.

5. The structure of fillings for openings according to claim 1, wherein the post-shock-absorbers are created from shock-absorbers with rather high elasticity, length and shock-absorbing power and the post-shock-absorbers are over three times longer and over two times more rigid than preliminary shock-absorbers , compared to the post-shock-absorbers, final pressure shock-absorbers are made of 10 to 60% shorter and over 1.5 times more rigid shock-absorbers, and preliminary , post and final pressure shock-absorbers are created as installations operating by the principle of an elastic spring.

6. The structure of fillings for openings according to claims 1, wherein the filler seal is of material with closed pores, and a surface of the filler seal of the shock-dampening and absorption system and the frames is covered with an elastically deformable material.

7. The structure of fillings for openings according to claim 1, wherein a surface of the outer glass of the outer glass set is covered with a light-reflecting layer.

8. The structure of fillings for openings according to claim 1, wherein a surface of the outer glass of the outer glass set is covered with a fine, electricity conductive mesh and the mesh is connected to earth and is covered by a cover with albedo value of over 90.

9. The structure of fillings for openings according to claim 1, wherein total weight of the structure of fillings for openings has been smoothly increased by a weight of an inertia weight element of the internal frame of the frame set, sheet material panel, frames and the load-bearing structure.

10. The structure of fillings for openings according to claim 1, wherein edges and corners of the inner and outer sheet material set and glass sets have curved surfaces.

11. The structure of fillings for openings according to claim 1, wherein the preliminary shock-absorbers are designed to operate in an impulse-stress stage of the shock wave 0 to 20% of an impact time, and by which a speed of shock wave has been reduced by 20 to 60% and the amount of pressure by 60 to 80%;

the post-shock-absorbers are designed to operate in a dynamic stress stage of the shock wave 10 to 40% of the impact time of the shock wave;

the final pressure shock-absorbers are designed to operate in a quasi-static stress and negative stress stages of the shock wave 20 to 80% of the impact time of the shock wave.

* * * * *